US005312495A

United States Patent [19]

Masumoto et al.

[11] Patent Number: 5,312,495

[45] Date of Patent: May 17, 1994

[54] PROCESS FOR PRODUCING HIGH STRENGTH ALLOY WIRE

[75] Inventors: Tsuyoshi Masumoto, 3-8-22, Kamisugi; Akihisa Inoue, 11-806, Kawauchijutaku, Mubanchi, Kawauchi, both of, Aoba-ku, Sendai-shi, Miyagi; Hirokazu Yamamoto, both of Sendai; Junichi Nagahora, Yokohama; Toshisuke Shibata, Sendai, all of Japan

[73] Assignees: Tsuyoshi Masumoto; Akihisa Inoue, both of Miyagi; Unitika Ltd., Hyogo; Kogyo K.K. Yoshida, Tokyo, all of Japan

[21] Appl. No.: 878,562

[22] Filed: May 5, 1992

[30] Foreign Application Priority Data

May 15, 1991 [JP] Japan ..... 3-138574

[51] Int. Cl.[5] ..... C22C 45/00

[52] U.S. Cl. ..... 148/550; 148/561; 148/403

[58] Field of Search ..... 148/550, 557, 561, 403

[56] References Cited

U.S. PATENT DOCUMENTS 4,135,924 1/1979 Tanner et al. ..... 148/403
5,074,935 12/1991 Masumoto et al. ..... 148/403

FOREIGN PATENT DOCUMENTS 0361136 4/1990 European Pat. Off. .
0433670 6/1991 European Pat. Off. .
2651246 3/1991 France .
3-87338 4/1991 Japan .
3-87339 4/1991 Japan .
2236325 4/1991 United Kingdom .

OTHER PUBLICATIONS

Patent Abstracts of Japan, Publication No. JP3087338, Apr. 12, 1991, Takeshi Masumoto et al, "Rare Earth Metal-Base Alloy Foil or Rare Earth Metal-Base Alloy Fine Wire and its Manufacture".
Derwent Abstract of French Patent No. 2651246, published Mar. 1, 1991.

*Primary Examiner*—George Wyszomierski
*Attorney, Agent, or Firm*—Flynn, Thiel, Boutell & Tanis

[57] ABSTRACT

The present invention provides a process comprising the steps of forming a cast amorphous alloy from an alloy which exhibits glass transition behavior, heating the amorphous alloy to a temperature between Tg and Tx while subjecting the alloy to drawing to obtain a wire and cooling the wire to (Tg-50 K) or lower. By this process, it is possible to produce an amorphous alloy wire at a low cost and provide an ultrafine wire having high strength and high corrosion resistance as well as flexibility. The amorphous alloy wire can be utilized as a reinforcing wire for a composite material, a variety of reinforcing members, a woven fabric and the like.

4 Claims, 4 Drawing Sheets

HIGH TEMPERATURE TENSILE TEST

PROCESS FOR PRODUCING HIGH STRENGTH ALLOY WIRE

BACKGROUND OF THE INVENTION

1. Field of the Invention

The present invention relates to a process for producing an alloy wire having excellent strength and corrosion resistance as well as flexibility.

2. Description of the Prior Art

The conventional production of an amorphous alloy wire has heretofore been carried out by means of the in-rotating-water spinning or the like, because of the high cooling rate required to obtain iron-based or nickel-based wires of several tens of μm in diameter. Advantage has been taken of the characteristics of the wires thus produced to use them as reinforcing fiber for automobile tire and women's underwear. However, the in-rotating-water spinning method using water as the cooling medium has been accompanied with difficulty in producing a sound wire from an alloy containing a reactive metal, such as Al, Mg, Zr or a rare earth metal.

As described hereinbefore, the production of usual amorphous alloy wire can be performed by the direct quenching method, such as the in-rotating-water spinning method, etc. However, in the case of an alloy containing a reactive metal, it is difficult to produce a sound alloy wire, since the alloy reacts with water to sometimes form an oxide film. On the other hand, as disclosed in Japanese Patent-Laid-Open Nos. 275732/1989, 10041/1991 and 36243/1991 and Japanese Patent application No. 158446/1991, an alloy which exhibits glass transition behavior can be made into a wire by conducting extrusion, rolling, drawing or the like singly or in combination thereof with an amorphous alloy obtained in the form of ribbon or powder. Although the above-disclosed production processes are excellent, they have suffered the disadvantage that each of them involves a lot of steps, leaving some room for economic improvement. Under such circumstances, it was found by the present inventors that an alloy exhibiting glass transition behavior as described in the aforestated patent applications can be made into an amorphous bulk material by means of in-rotating-water spinning, direct casting or the like, and the patent application was already filed (Japanese Patent application No. 49491/1990). Later on, it was further found by the present inventors that a continuous wire can be produced easily and economically by subjecting the bulk material to drawing at a temperature in the range of the glass transition temperature (Tg) to the crystallization temperature (Tx), which finding finally led to the present invention.

SUMMARY OF THE INVENTION

The first aspect of the present invention relates to a process for producing an amorphous alloy wire by a simplified and economical way, more particularly, to a process for producing a high-strength alloy wire characterized by producing a cast amorphous alloy having a polygonal or circular cross section from an alloy which exhibits glass transition behavior; heating the amorphous alloy to a temperature between the glass transition temperature (Tg) of the alloy and the crystallization temperature (Tx) of the alloy while subjecting the alloy to drawing to obtain a wire; and, after attaining the prescribed cross-sectional area, cooling the wire thus obtained to a temperature not higher than (Tg-50 K).

The second aspect of the present invention relates to a process for continuously producing the above-mentioned alloy wire, more particularly to a process for producing a high-strength alloy wire characterized by producing a cast amorphous alloy having a circular or polygonal cross section from an alloy which exhibits glass transition behavior; continuously introducing the amorphous alloy into one or more heating zones arranged in series; heating the amorphous alloy to a temperature between the glass transition temperature (Tg) of the alloy and the crystallization temperature (Tx) of the alloy while subjecting the alloy to single stage or multi-stage drawing in each heating zone to obtain a wire; and, after attaining the prescribed cross-sectional area, continuously cooling the wire thus obtained to a temperature not higher than (Tg-50 K).

The alloy which exhibits glass transition behavior is selected from the alloys represented by the general formulae.

(1) General formula: $Al_aM^1_bX^1_c$ wherein $M^1$ is at least one metallic element selected from the group consisting of V, Cr, Mn, Fe, Co, Ni, Cu, Zr, Ti, Mo, W, Ca, Li, Mg and Si; $X^1$ is at least one metallic element selected from the group consisting of Y, La, Ce, Sm, Nd, Hf, Nb, Ta and Mm (misch metal); and a, b and c are, in atomic percentage, $50 \leqq a \leqq 95\%$, $0.5 \leqq b \leqq 35\%$ and $0.5 \leqq c \leqq 25\%$.

(2) General formula: $Al_{100-(d+e)}M^2_dX^2e$ wherein $M^2$ is at least one element selected from the group consisting of Ti, V, Cr, Mn, Fe, Co, Ni, Cu, Zr, Nb, Mo, Hf, Ta and W; $X^2$ is at least one element selected from the group consisting of Y, La, Ce, Nd, Sm and Gd or Mm (misch metal); and d and e are, in atomic percentage, $d \leqq 55\%$, $30 \leqq e \leqq 90\%$ and $50\% \leqq d+e$.

(3) General formula: $X^3_fM^3_g Al_h$ wherein $X^3$ is at least one element selected from the group consisting of Zr and Hf; $M^3$ is at least one element selected from the group consisting of Ni, Cu, Fe, Co and Mn; and f, g and h are, in atomic percentage, $25 \leqq f \leqq 85\%$, $5 \leqq g \leqq 70\%$, $h \leqq 35\%$ and $50\% \leqq f+g$.

(4) General formula: $Mg_jX^4_kLn_m$ or $Mg_jX^4_kM^4_nLn_m$ wherein $X^4$ is at least one element selected from the group consisting of Cu, Ni, Sn and Zn; $M^4$ is at least one element selected from the group consisting of Al, Si and Ca; Ln is at least one element selected from the group consisting of Y, La, Ce, Nd, Sm and Gd or Mm (misch metal); and j, k, n and m are, in atomic percentage, $40 \leqq j \leqq 90\%$, $4 \leqq k \leqq 35\%$, $2 \leqq n \leqq 25\%$ and $4 \leqq m \leqq 25\%$.

These alloys can be obtained in the form of bulk and amorphous single phase which exhibit glass transition behavior by solidifying the melt of the alloy at a cooling rate of $10^2$ K/sec or more. It is generally known that an alloy exhibiting glass transition behavior turns into a supercooled liquid in the region of the glass transition and can be deformed with ease to a great extent by an extremely low stress, usually 10 MPa or less. An amorphous alloy for practical use exhibiting glass transition behavior had not been found until the amorphous alloy was disclosed by the aforesaid patent application.

DETAILED DESCRIPTION OF THE PREFERRED EMBODIMENTS

Figure 1:
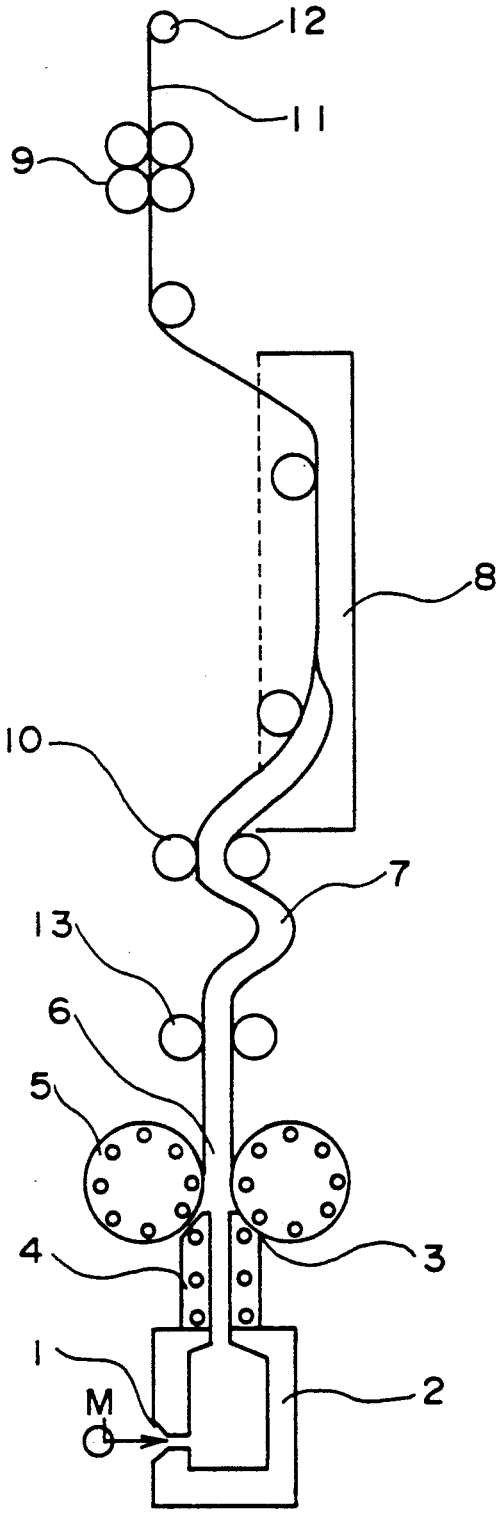
FIG. 1 is an explanatory drawing showing one example of apparatuses well suited to the process of the present invention.

The present invention provides a process for intermittently or continuously producing a wire an amorphous alloy which comprises heating a cast amorphous alloy obtained by the continuous or discontinuous casting process to the glass transition temperature region peculiar to the amorphous alloy and subjecting the alloy to drawing taking advantage of the characteristics of the alloy as the supercooled liquid in the aforesaid temperature region. In this case, importance is attached to the steps wherein a workpiece is subjected to drawing to reduce the cross-sectional area to a prescribed level and thereafter cooling to (Tg-50 K) or lower. By the above cooling, the stress required for the deformation of the workpiece abruptly increases and, thereby, the subsequent deformation is suppressed, thus enabling the production of a continuous wire having a stabilized cross-sectional area. The glass transition temperature (Tg) and region thereof depend upon each alloy, and even in the Tg region, crystallization proceeds when a workpiece is maintained in this region for a long time, thereby restricting the heating temperature of the workpiece and the time during which it may be maintained at the temperature depending upon the alloy to be used. According to the result of an experiment made by the present inventors, as a general rule, the heating temperature should be set at a temperature higher than the Tg and lower than the Tx, preferably higher than the Tg and lower than $(Tg+Tx)\times\frac{2}{3}$, with a temperature control range of $\pm 0.3\times(Tx-Tg)$, with the proviso that the heating temperature should be in the range of Tg to Tx and the allowable holding time should not exceed the value of $(Tx-Tg)$ (in terms of minute), preferably $(Tx-Tg)\times\frac{1}{3}$ (in terms of minute). As an Al-based amorphous alloy has a relatively small value of $\Delta T$ $(Tx-Tg)$, that is, 5 to 10 K, a recommended holding time thereof is one minute at the maximum, preferably 30 seconds or shorter. As Mg-based and rare earth metal-based amorphous alloys each have a relatively large $\Delta T$ value, that is, 30 to 90 K, the allowable holding time thereof is 30 minutes, approximately. On the other hand, Zr-based and Hf-based alloys do not follow the aforestated general conditions and require lower heating temperature and shorter holding time.

The heating rate up to a glass transition region should be 10 K/min or higher, preferably 40 K/min or higher for Al-based and Zr-based alloys. The cooling after drawing is preferably carried out at a rate of 100 K/min or higher to a temperature of not higher than (Tg-50 K) in order to prevent brittleness due to structural relaxation below the Tg, but a proper temperature gradient may be set to control the diameter of an alloy wire as the case may be. When the drawn wire is cooled to a temperature as low as Tg-50 K, the stress required for deformation amounts to 3 to 5 times that in the glass transition region, thus preventing the cross-sectional area from decreasing under the stress after the drawing.

During the drawing, the strain rate may be $10^{-5}$ to $10^{2}$/sec and the drawing stress ranges from 10 to 60 MPa depending upon the type of alloy and strain rate. These are controlled by adjusting the feed rate of an amorphous alloy bulk material, the pulling rate of the drawn wire and the quality of the wire.

In the case of a larger $\Delta T$, the steps of bulk material production (casting), temperature raising, drawing and cooling may be carried out either individually or continuously as a series of steps. In the case where strict control of temperature and holding time is needed, depending on the type of alloy, the type of the above steps is selected from the economic point of view.

The production of the bulk material is carried out by direct casting in a metal mold made of iron or copper, or continuous casting in a mobile mold comprising a pair of rotary copper wheels having a prescribed shape of grooves, a rotary copper wheel and a stainless stress belt, or the like. In the case of the above-mentioned alloy, a bar or continuous rod having a diameter of 0.5 to 10 mm is obtained as an amorphous bulk material.

In order to attain a cooling rate of $10^{2}$ K/sec, the temperature of a melt to be cast is preferably lower than the melting point (Tm) plus 200 K and the temperature of the mold is preferably sufficiently low, i.e., not higher than (Tg-100 K).

Examples of effective methods for heating the bulk material to a glass transition temperature region include the use of generally known furnaces, oil baths, electromagnetic induction furnaces and optical image furnaces, or the like, and, in the case where the bulk material has a small cross-sectional area, e.g., 2 mm or smaller in diameter, a method wherein the bulk material is brought into contact with a roll which is heated to a prescribed temperature is also effective. The heating rate is preferably $10^{2}$ K/min or higher for an Al-based alloy with a small $\Delta T$ value but is not specifically limited for other types of alloys.

The drawing is carried out simultaneously with the heating in the heating zone(s). In the case of separate drawing, a workpiece is drawn at a constant rate, that is, $10^{-5}$ to $10^{1}$/sec in terms of strain rate with both the ends fixed with jigs. In the case of continuous drawing, the drawing is usually performed by the difference in velocity between a feed roll and a drawing roll or pull-out roll. Depending on the type of an alloy, it is sometimes effective to divide the drawing process into two or more steps that are continuous or independent of each other.

Now the present invention will be described in more detail with reference to the examples.

EXAMPLE 1

A molten alloy (melt M) having a composition of $La_{55}Al_{25}Ni_{20}$ in atomic % was produced using a high-frequency induction furnace, poured into a melt feed path 2 through a gate 1 of a casting apparatus as shown in FIG. 1, pressurized under a constant pressure by means of a pressure pump towards a weir 3 through the above path 2, cooled to a prescribed temperature in the first-stage quenching zone (temperature control section) 4 that was installed in the path 2, forced into a solidification zone 6 constituted of a pair of water cooled rolls 5 provided with grooves at a constant flow rate through the weir 3 and solidified continuously at a cooling rate of about $10^{2}$ K/sec to obtain a continuous cast bar 7 of 2.5 mm in diameter through a pull-out roll 13. The above continuous cast bar 7 was installed close to the casting apparatus, introduced into an oil bath controlled to 483±1 K and subjected to drawing while heating, by applying tension with a drawing roll 9 installed at the rear of the oil bath 8. The drawing rate was controlled so as to attain the rate of 100 times the feed rate of the continuous cast bar 7 by linking the roll 9 to a continuous cast bar feed roll 10. The drawing was conducted at a drawing stress of 15 MPa and a strain rate of $5\times10^{-2}$/sec, each being based on the cross-sectional area of the bar 7. The drawn alloy wire 11 was taken out from the oil bath when the prescribed cross-sectional shape was attained to maintain the cross-sectional area or diameter at a constant level, air cooled and thereafter wound on a take-up roll 12. As a result, the alloy wire (spinning wire) thus obtained had a diameter of 250 μm and a circular cross section, each being stabilized in the longitudinal direction.

Figure 2:
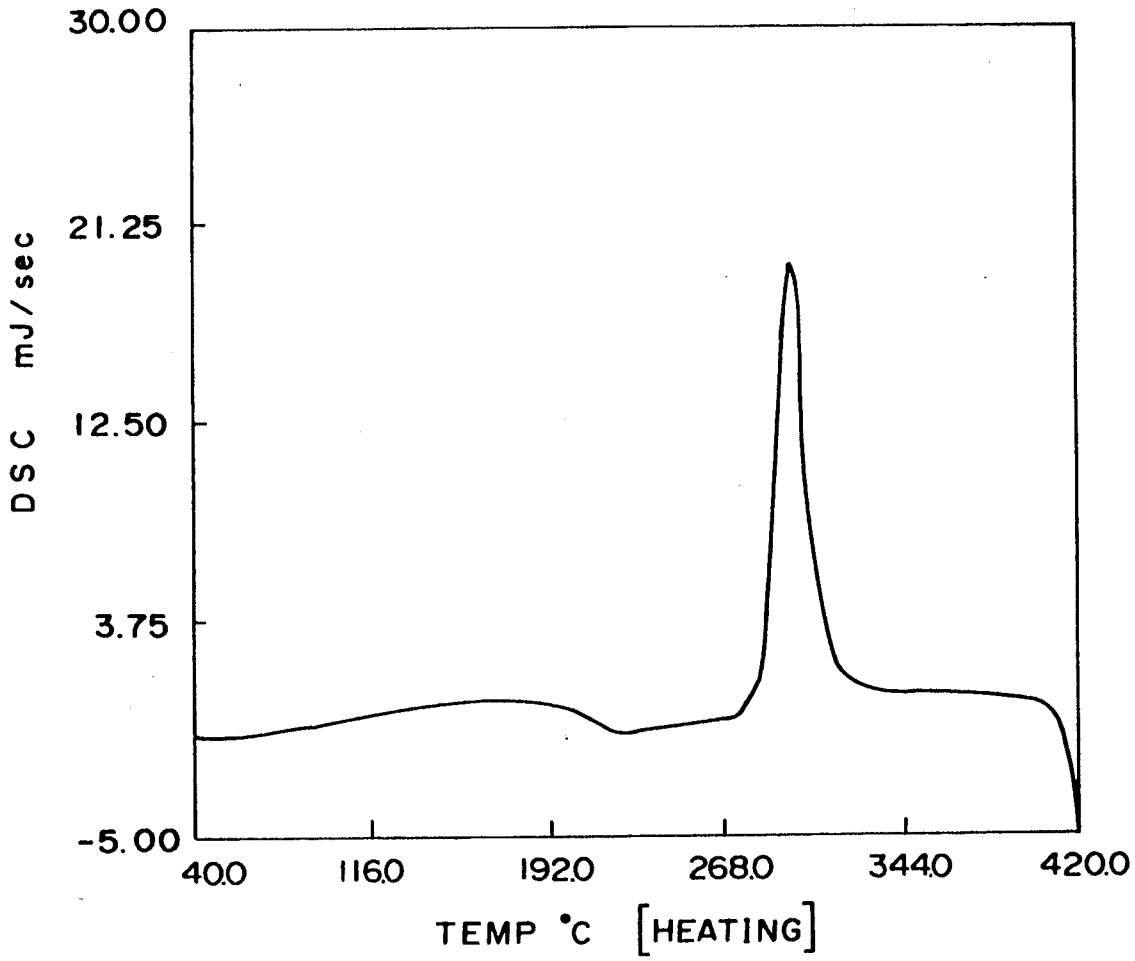
FIG. 2 is a graph showing the differential scanning calorimetry (DSC) result of the continuous cast bar obtained according to the process of the present invention.
Figure 3:
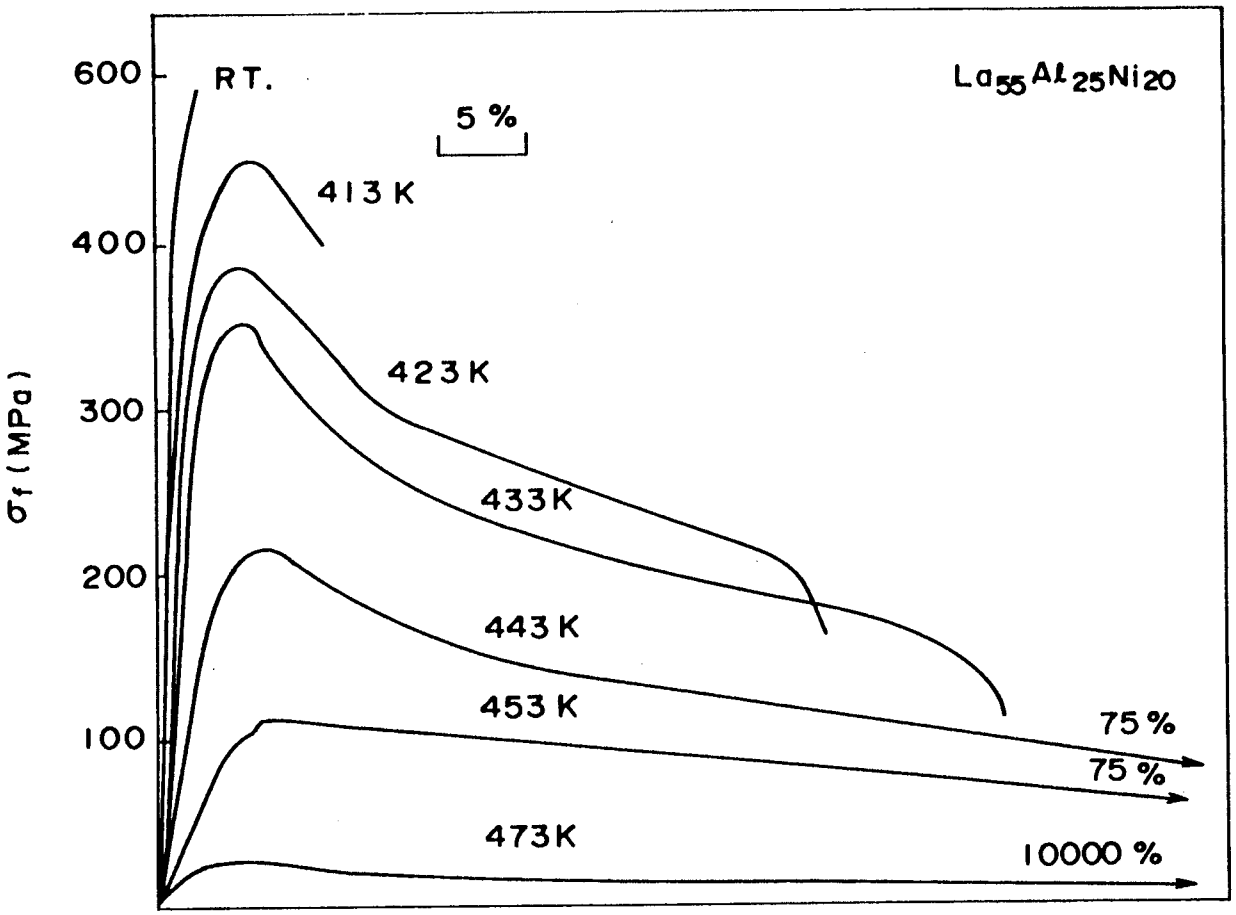
FIG. 3 is a graph showing the result of tensile test at an elevated temperature.

The continuous cast bar 7 thus obtained was examined by differential scanning calorimetry (DSC) to obtain a curve as given in FIG. 2. As the curve indicates the glass transition temperature of 470.3 K and the crystallization temperature of 553.6 K, the cast bar 7 showed an elongation of 10,000% or more in the glass transition region as shown by the result of the high temperature tensile test of FIG. 3. The above drawing condition was selected in this way.

Figure 4:
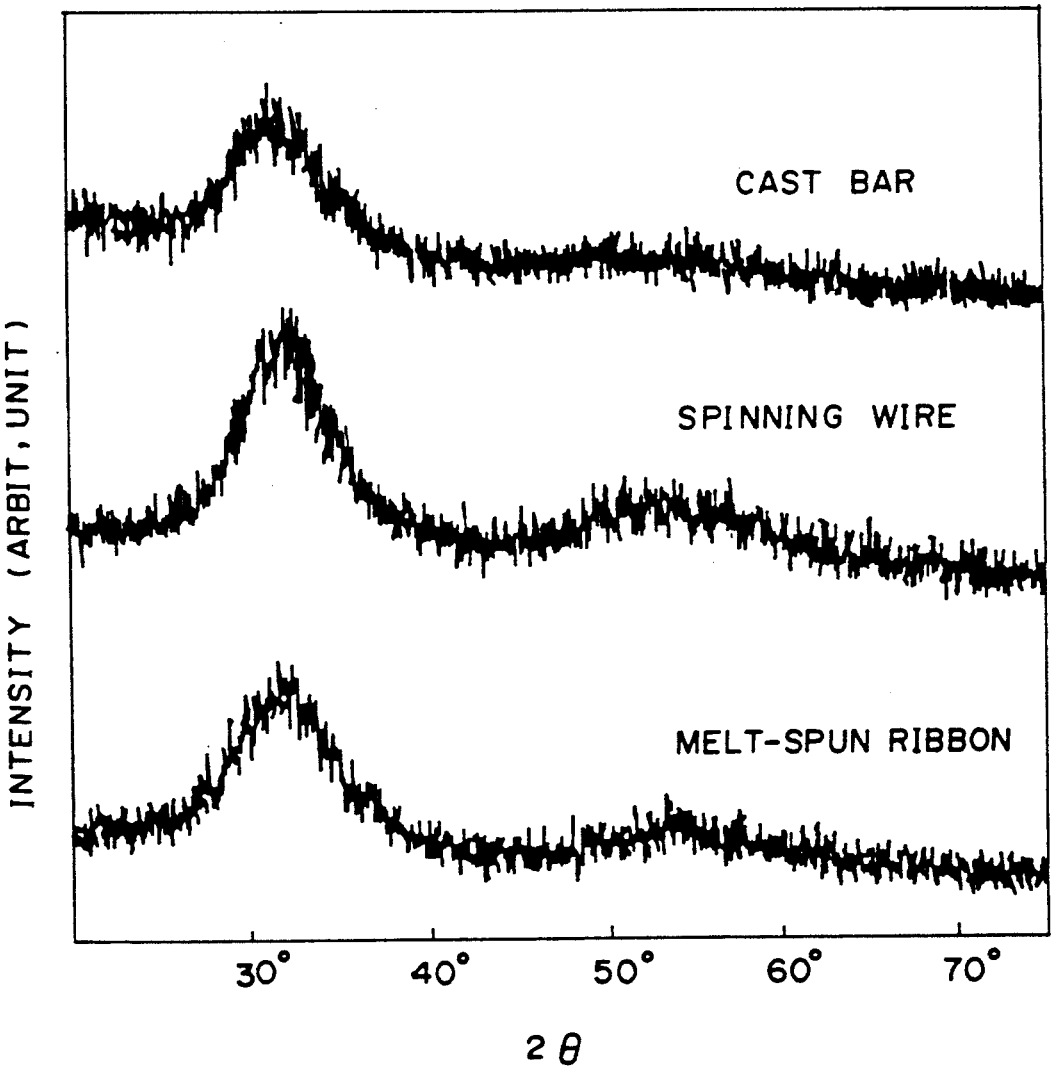
FIG. 4 is a graph showing the results of X-ray diffraction tests for the material obtained in Examples before and after drawing.

Examination was made to see whether or not the material before or after the drawing was amorphous by means of X-ray diffraction. The result is given in FIG. 4, in which each of the materials exhibited a halo pattern peculiar to amorphous material, demonstrating the amorphism of each of the materials before and after the drawing.

As a result of a tensile strength test at room temperature, the continuous cast bar had a tensile strength of 570 MPa and the spinning wire had that of 578 MPa, each having excellent mechanical strength.

EXAMPLE 2

The alloy wire as obtained in Example 1 was further drawn under the same drawing condition as that of Example 1. As a result, an alloy wire of 25 μm in diameter was obtained still in the amorphous form, proving that at least two-stage drawing was possible.

EXAMPLE 3

By the use of the apparatus shown in FIG. 1, an alloy wire of 200 μm in diameter was obtained from an alloy having a composition of $Zr_{70}Ni_{15}Al_{15}$ in atomic %.

In this example, the procedure of Example 1 was repeated except that the temperature was raised to 680±5 K, that is, the drawing temperature, by the combined use of an electromagnetic induction furnace and an electric-resistance heating furnace instead of the oil bath, and the drawing was carried out at a drawing stress of 20 MPa and a strain rate of $7\times10^{-2}$/sec. The alloy wire thus obtained was amorphous and had a tensile strength at room temperature of 1650 MPa, that is, a high strength.

EXAMPLE 4

By the use of the apparatus shown in FIG. 1, an alloy wire of 250 μm in diameter was obtained from an alloy having a composition of $Mg_{70}Cu_{10}La_{20}$ in atomic %.

In this example, the procedure of Example 1 was repeated except that the oil bath temperature was set at 440±1 K, and the drawing was effected at a drawing stress of 20 MPa and a strain rate of $3\times10^{-2}$/sec. The alloy wire thus acquired was amorphous and has a tensile strength at room temperature of 650 MPa.

As can be seen from the foregoing examples, the process according to the present invention is excellent as a process for economically producing an amorphous alloy wire which exhibits glass transition behavior. The above-mentioned process is applicable not only to the above-exemplified alloy systems but also to those outside the above insofar as the amorphous alloy systems exhibit glass transition behavior.

The process according to the present invention, when used in combination with the conventional continuous casting process, is capable of producing an amorphous alloy wire at a low cost and providing an ultrafine wire having high strength and high corrosion resistance. The amorphous alloy wire thus obtained can be utilized as a reinforcing wire for a composite material, a variety of reinforcing members, a woven fabric each having high strength and high corrosion resistance, and the like.

We claim:

1. A process for producing a high-strength alloy comprising the steps of forming a cast amorphous alloy having a circular or polygonal cross section from an alloy which exhibits glass transition behavior; heating the amorphous alloy at a heating rate of at least 10 K/min to a temperature between the glass transition temperature (Tg) of the alloy and the crystallization temperature (Tx) of the alloy while subjecting the alloy to drawing such that the drawing stress is controlled by adjusting the feed rate and pulling rate of the amorphous alloy to obtain a wire; and, after attaining the desired cross-sectional area, cooling the wire thus obtained at a cooling rate of at least 100 K/min to a temperature not higher than (Tg-50 K).

2. A process for producing a high-strength alloy wire comprising the steps of forming a cast amorphous alloy having a circular or polygonal cross section from an alloy which exhibits glass transition behavior; continuously introducing the amorphous alloy into one or more heating zones arranged in series; heating the amorphous alloy at a heating rate of at least 10 K/min to a temperature between the glass transition temperature (Tg) of the alloy and the crystallization temperature (Tx) of the alloy while subjecting the alloy to single stage or multistage drawing in each heating zone such that the drawing stress is controlled by adjusting the feed rate and pulling rate of the amorphous alloy to obtain a wire; and, after attaining the desired cross-sectional area, continuously cooling the wire thus attained at a cooling rate of at least 100 K/min to a temperature not higher than (Tg-50 K).

3. A process for producing a high-strength alloy comprising the steps of forming a cast amorphous alloy having a circular or polygonal cross section from an alloy which exhibits glass transition behavior; heating the amorphous alloy to a temperature between the glass transition temperature (Tg) of the alloy and the crystallization temperature (Tx) of the alloy while subjecting the alloy to drawing such that the drawing stress is controlled by adjusting the feed rate and pulling rate of the amorphous alloy such that the strain rate during drawing is from $10^{-5}$ to $10^{2}$/sec and the drawing stress is from 10 to 60 MPa to obtain a wire; and, after attaining the desired cross-sectional area, cooling the wire thus obtained to a temperature not higher than (Tg-50 K).

4. A process for producing a high-strength alloy wire comprising the steps of forming a cast amorphous alloy having a circular or polygonal cross section from an alloy which exhibits glass transition behavior; continuously introducing the amorphous alloy into one or more heating zones arranged in series; heating the amorphous alloy to a temperature between the glass transition temperature (Tg) of the alloy and the crystallization temperature (Tx) of the alloy while subjecting the alloy to single stage or multistage drawing in each heating zone such that the drawing stress is controlled by adjusting the feed rate and pulling rate of the amorphous alloy such that the strain rate during drawing is from $10^{-5}$ to $10^{2}$/sec and the drawing stress is from 10 to 60 MPa to obtain a wire; and, after attaining the desired cross-sectional area, continuously cooling the wire thus attained to a temperature not higher than (Tg-50 K).

* * * * *

UNITED STATES PATENT AND TRADEMARK OFFICE

CERTIFICATE OF CORRECTION

PATENT NO. : 5 312 495

DATED : May 17, 1994

INVENTOR(S) : Tsuyoshi MASUMOTO, et al

It is certified that error appears in the above-indentified patent and that said Letters Patent is hereby corrected as shown below:

On the title page, item [73] change the name of Assignee; "Kogyo K.K. Yoshida," to ---Yoshida Kogyo K.K.,---.

Signed and Sealed this

Eleventh Day of October, 1994

*Attest:*

*Attesting Officer*

Bruce Lehman

BRUCE LEHMAN

*Commissioner of Patents and Trademarks*